US008866564B2

(12) United States Patent
Monte

(10) Patent No.: US 8,866,564 B2
(45) Date of Patent: Oct. 21, 2014

(54) ORTHOMODE TRANSDUCER DEVICE

(75) Inventor: Thomas D. Monte, Homer Glen, IL (US)

(73) Assignee: KVH Industries, Inc., Middletown, RI (US)

( * ) Notice: Subject to any disclaimer, the term of this patent is extended or adjusted under 35 U.S.C. 154(b) by 338 days.

(21) Appl. No.: 13/473,690

(22) Filed: May 17, 2012

(65) Prior Publication Data

US 2013/0207742 A1 Aug. 15, 2013

Related U.S. Application Data

(60) Provisional application No. 61/596,818, filed on Feb. 9, 2012.

(51) Int. Cl.
*H01P 1/16* (2006.01)
*H01P 5/12* (2006.01)

(52) U.S. Cl.
USPC ..... 333/126; 333/21 R; 333/135; 333/137

(58) Field of Classification Search
USPC ..... 333/126, 127, 135, 137, 21 A, 21 R
See application file for complete search history.

(56) References Cited

U.S. PATENT DOCUMENTS

| | | | |
|---|---|---|---|
| 3,050,701 | A | 8/1962 | Tang et al. |
| 3,569,871 | A | 3/1971 | Tomiyasu |
| 3,731,235 | A | 5/1973 | Ditullio et al. |
| 4,847,574 | A | 7/1989 | Gauthier et al. |
| 5,684,495 | A | 11/1997 | Dyiott et al. |
| 6,329,957 | B1 | 12/2001 | Shea et al. |
| 6,566,976 | B2 | 5/2003 | Krishmar-Junker et al. |

OTHER PUBLICATIONS

Cavalier, Mark D. et al., "Antenna System for Multiband Satellite Communications", MILCOM 97 Proceedings, Nov. 1997.
Beadle, M et al., "A C/X/Ku-band dual polarized Cassegrain antenna system", Antennas and Propagation Society International Symposium, 1999. IEEE, vol. 1, No., pp. 692-695 vol. 1, Aug. 1999.
Cavalier, Mark, "Marine Stabliized Multiband Satellite Terminal", MILCOM 2002 Proceedings, Oct. 2002.
Arndt, F. et al., "Conical circular waveguide with side-coupled rectangular ports analyzed by a hybrid mode-matching/method-of-moment technique", Microwave Conference, 2005 European, vol. 2, No., p. 4 pp., Oct. 4-6, 2005.
Uher, J. et al, "Waveguide Components for Antenna Feed Systems: Theory and CAD", Artech House Antennas and Propagation Library, 1993, pp. 413-418, Combiner Design Type 3 (Symmetrical Branching Approach).
Cavalier, Mark D., "Feed for Simultaneous X-Band and Ka-Band Operations on Large Aperture Antennas", MILCOM 2007 Proceedings, Oct. 2007.

*Primary Examiner* — Robert Pascal
*Assistant Examiner* — Kimberly Glenn
(74) *Attorney, Agent, or Firm* — Lowenstein Sandler LLP

(57) ABSTRACT

The present invention is an orthomode transducer (OMT) device that allows for dual polarized dual frequency band antenna feed systems. The OMT device includes a waveguide structure having a first end and a second end such that the first end defines a port for receiving signals. The waveguide structure includes an outer wall defining a waveguide chamber therein and the outer wall includes a first cylindrical section proximate the first end. The waveguide structure also includes a second cylindrical section proximate the second end and a region therebetween. At least one longitudinal groove is introduced proximate the second end and extends towards the first end of the waveguide structure. The OMT device further includes at least one waveguide coupled to the outer wall of the waveguide chamber which is in signal communication with the waveguide chamber through an opening in the region of the outer wall.

28 Claims, 3 Drawing Sheets

ORTHOMODE TRANSDUCER DEVICE

CROSS-REFERENCES

This patent application claims the benefit of U.S. Provisional Application Ser. No. 61/596,818 filed Feb. 9, 2012, the contents of which are incorporated by reference herein

FIELD OF THE INVENTION

Embodiments of the invention are generally related to the field of satellite communication and antenna systems, and more particularly to an orthomode transducer device that allows for dual polarized dual frequency band antenna feed systems.

BACKGROUND OF THE INVENTION

Satellite antenna systems receive signals from satellites orbiting the earth. The satellite is equipped with an antenna system including a configuration of antenna feeds that receive the uplink signals and transmit the downlink signals to the Earth. Typically, the antenna system includes one or more arrays of feed horns, where each feed horn array includes an antenna reflector for collecting and directing the signals. Many satellite communications systems use the same antenna system and array of feed horns to receive the uplink signals and transmit the downlink signals. Combining satellite uplink signal reception and downlink signal transmission functions for a particular coverage area using a reflector antenna system requires specialized feed systems capable of supporting dual frequencies and providing dual polarization.

A dual polarized waveguide junction with one or two sets of single polarized side waveguide ports is a basic component of dual polarized dual frequency band antenna feed systems. This type of device is known to one skilled in the art as an ortho-mode transducer (OMT) or ortho-mode junction (OMJ). The OMT or OMJ in combination with each feed horn provide signal combining and isolation to separate the uplink and downlink signals.

An early example of a OMJ is disclosed in U.S. Pat. No. 3,731,235. The OMJ of this patent outlines a circular waveguide with a set of four symmetrical openings around the periphery of the waveguide.

A current example of an OMJ is disclosed in U.S. Pat. No. 6,566,976. The patent discloses a symmetric orthomode coupler for a satellite communication system. More specifically, it discloses a tapered orthomode coupler that allows for dual sense polarization for both transmission and reception frequency bands.

The current orthomode couplers are limited in their ability to provide an extended operational bandwidth and mode purity of the highest frequency signals. Thus, there is a need in the art to provide an orthomode coupler that extends the operational bandwidth and transfers the highest frequency signals through the OMJ with minimal modal distortion and low return loss. It is therefore an object of the present invention to provide such improved orthomode coupler.

SUMMARY OF THE INVENTION

Embodiments of the present invention provide an orthomode transducer (OMT) device that allows for dual polarized dual frequency band antenna feed systems. The OMT device includes a waveguide structure having a first end and a second end such that the first end defines a port for receiving signals. The waveguide structure includes an outer wall defining a waveguide chamber therein and the outer wall includes a first cylindrical section proximate the first end. The waveguide structure also includes a second cylindrical section proximate the second end and a region therebetween. At least one longitudinal groove is introduced proximate the second end and extends towards the first end of the waveguide structure. The OMT device further includes at least one waveguide coupled to the outer wall of the waveguide chamber which is in signal communication with the waveguide chamber through an opening in the region of the outer wall. At least one waveguide includes an iris aligned within the at least one longitudinal groove of the section.

In one embodiment, the OMT device includes a dielectric rod mounted coaxially within the waveguide chamber extending from the first end to the second end of the waveguide structure.

In one embodiment, the OMT device includes at least two equally spaced longitudinal grooves gradually introduced approximate the second end and placed in the first end of the waveguide structure.

In another embodiment, the OMT device includes four equally spaced longitudinal grooves such that each of the four longitudinal grooves is gradually introduced approximate the second end and placed in the first end of the waveguide structure.

In one embodiment, the OMT device includes four waveguides equally spaced around the section of the outer wall of the waveguide chamber.

In one embodiment, the region of the outer wall of the waveguide structure is tapered such that the outer wall tapers toward the second cylindrical section.

In one embodiment, the tapered region includes a first low higher-order mode generation taper shaped and sized to transition from the first cylindrical section to the second cylindrical section and provides for low generation of higher order modes of high frequency signals.

In one embodiment, the tapered region includes a second low higher-order mode generation taper shaped and sized to conform to at least one longitudinal groove and provides for low generation of higher order modes of high frequency signals.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1:
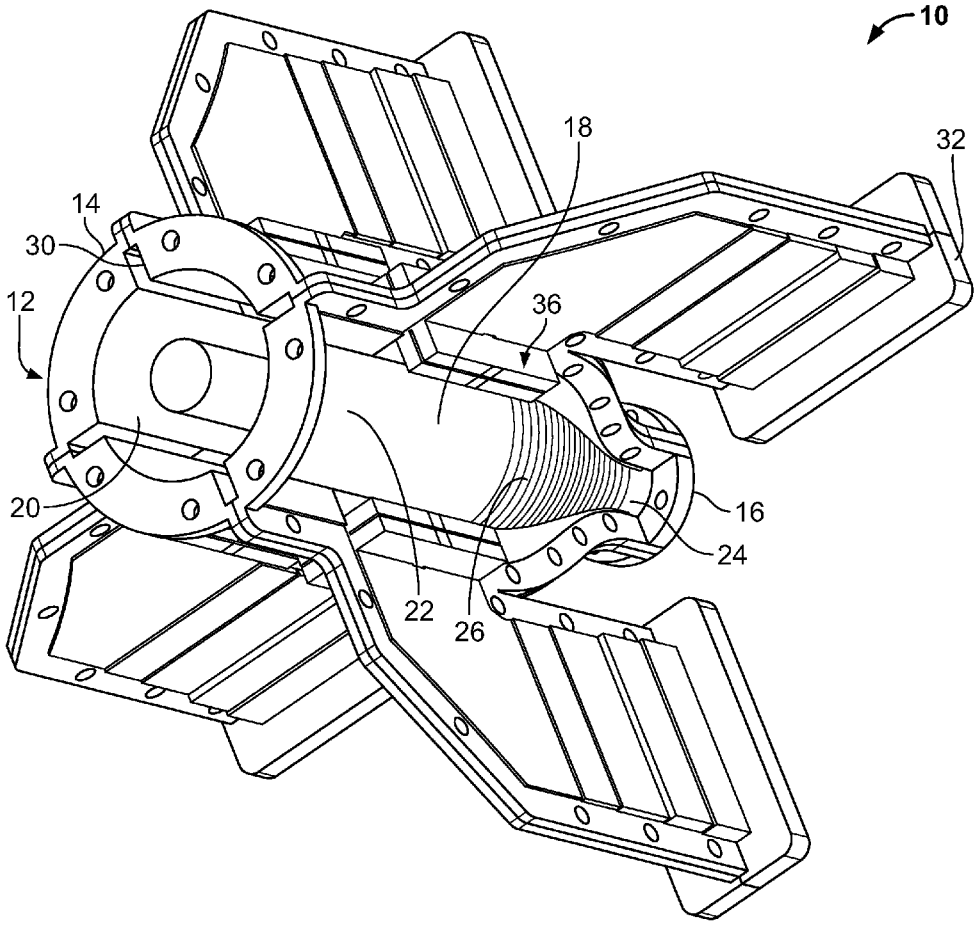
FIG. 1 depicts a schematic drawing of one embodiment of an orthomode transducer device of the present invention.
Figure 2:
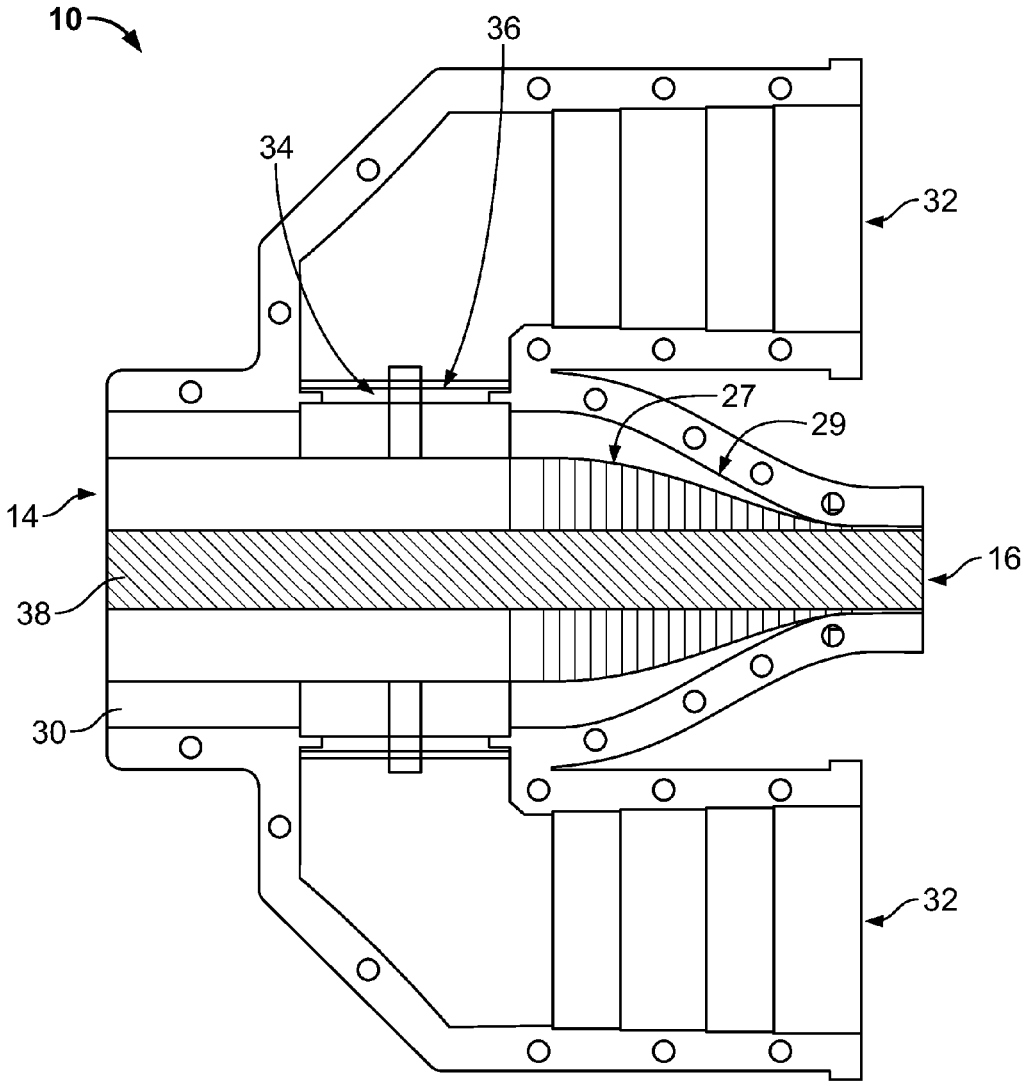
FIG. 2 depicts a schematic drawing of a cross-sectional view of the orthomode transducer device shown in FIG. 1 in a longitudinal direction.
Figure 3:
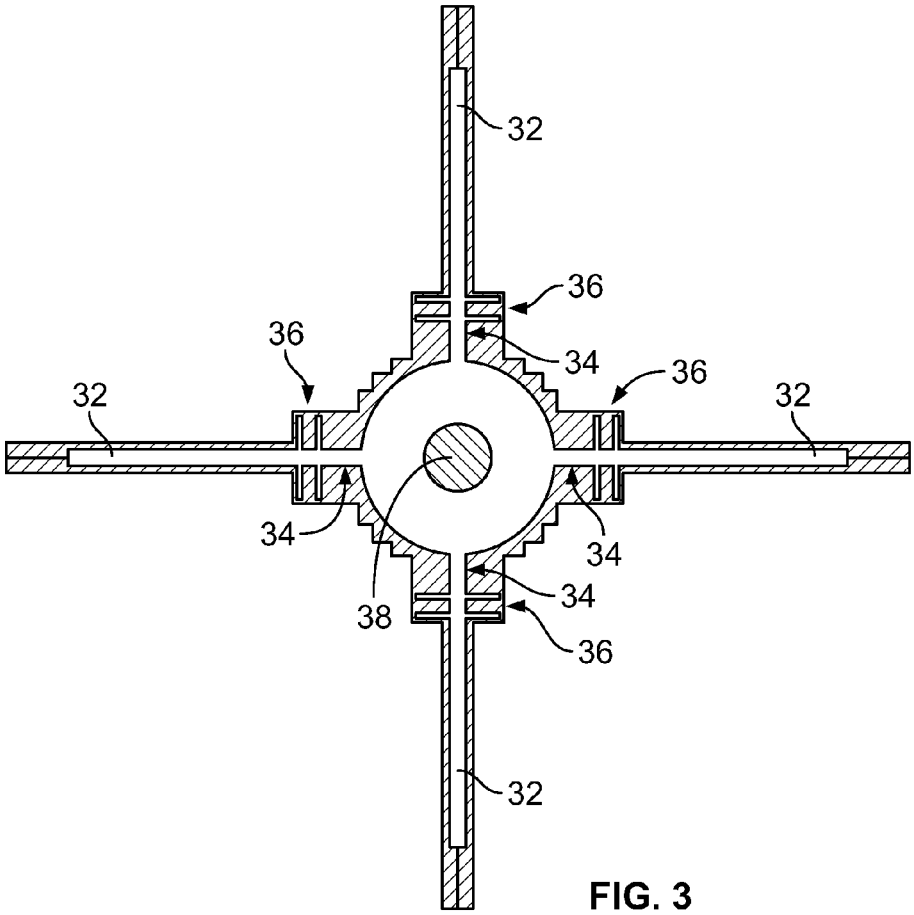
FIG. 3 depicts a schematic drawing of a cross-sectional view of the orthomode transducer device shown in FIG. 1 in a transverse direction.

FIGS. 1, 2 and 3 illustrate various views of an OMT device 10 according to an embodiment of the present invention. The OMT device 10 includes a waveguide structure 12 having a first end 14 and a second end 16. The first end 14 defines a first port for the signals, and the second end 16 defines a second port for signals. The waveguide structure 12 includes an outer wall 18 which defines a waveguide chamber 20 therein. In one embodiment, the outer wall 18 is made of any suitable conductive metal such as aluminum, copper and others. The outer wall 18 has a first cylindrical section 22 proximate the first end 14 and a second cylindrical section 24 proximate the second end 16. The outer wall 18 also includes a region 26 between the first cylindrical section 22 and the second cylindrical section 24. As shown in FIG. 2, the region (a.k.a. tapered region) 26 is tapered such that the outer wall 18 tapers towards the second cylindrical section 24. The region 26 includes a first low higher-order mode generation taper 27 and a second low higher-order mode generation taper 29. The first low higher-order mode generation taper 27 is the taper of the circular waveguide from the second end 16 to the first end 14 as illustrated in FIG. 2. The OMT device 10 also includes at least one longitudinal groove 30 gradually introduced proximate the second end 16 and extends towards the first end 14 of the tapered region 26 of the waveguide structure 12. As shown in FIG. 2, the depth or shape of the longitudinal groove 30 within the tapered region 26 between the first end 14 and the second end 16 follows the second low-higher-order mode generation taper 29. In one embodiment, four such equally spaced longitudinal grooves 30 are provided in the tapered region 26 of the waveguide structure 12 as shown in FIG. 1. In alternate embodiments, a different number of longitudinal grooves 30, such as two longitudinal groves, may be provided in the tapered region 26 of the waveguide structure 12.

In one embodiment, the first low higher-order mode generation taper 27 defines a profile of the first and the second cylindrical sections 22 and 24 respectively, of the outer wall 18 as will be described in greater detail below. In another embodiment, the second low higher-order mode generation taper 29 defines the profile of longitudinal grooves 30 as will be described in greater detail below. In even another embodiment, the first and the second low higher-order mode generation tapers 27 and 29 respectively are shaped and sized to provide for low generation of higher order modes of high frequency signals as will be described in greater detail below.

The OMT device 10 further includes at least one waveguide 32 coupled to the outer wall 18 of the waveguide structure 12. In one embodiment, at least four waveguides 32 are equally spaced and are symmetrically disposed around the tapered region 26 of the outer wall 18. In one embodiment, each of the four waveguides 32 is in signal communication with the waveguide chamber 20 through an opening in the tapered region 26 of the outer wall 18. In another embodiment, each of the four waveguides 32 communicates with the waveguide chamber 20 through the first cylindrical section 22 of the outer wall. In alternate embodiments, a different number of waveguides, such as two waveguides, may be coupled to the outer wall 18 of the waveguide structure 12. In one embodiment, the waveguides 32 are rectangular shaped, however, in alternate embodiments; the waveguides 32 may include various other shapes.

As shown in FIGS. 2 and 3, each of the waveguides 32 includes an iris or an iris opening 34 aligned within the longitudinal groove 30 of the waveguide structure 12. In one embodiment, the iris opening 34 is located in the first cylindrical section 22 within the longitudinal groove 30. Specifically, a symmetrical set of four irises openings 34 are located in the first cylindrical section 22 within each of the corresponding longitudinal grooves 30. In another embodiment, a symmetrical set of four irises openings 34 are located in the tapered region 26. In even a further embodiment, a symmetrical set of four irises opening 34 are located partially in each of the first cylindrical section 22 and the tapered region 26. Additionally, each of the waveguides 32 also includes a filter 36 coupled to the iris opening 34. Specifically, a symmetrical set of four filters 36 are provided in the waveguides 32. In one embodiment, the filters 36 are shaped in the form of waveguide corrugations or chokes. In this embodiment, the irises openings 34 and the filters 36 are rectangular shaped, however, in alternate embodiments; these components may be made of different configurations.

In one embodiment, the waveguide chamber 20 receives low frequency band signals through the port of the first end 14 of the waveguide structure 12 and emits the low frequency band signals via the waveguides 32. Each of the iris openings 34 function to couple the low frequency band signals into the corresponding waveguides 32. In another embodiment, the waveguide chamber 20 receives and emits high frequency band signals through the port of the first end 14 of the waveguide structure 12. The filters 36 function to reduce the high frequency band signals from entering into each of the corresponding waveguides 32 which are low frequency band waveguides.

As known to one skilled in the art, larger operating bandwidth requires a larger base symmetrical waveguide to propagate the lowest frequency. Therefore, at the highest frequency, there are several undesirable higher-order modes which propagate in the symmetrical base waveguide due to the larger dimensions. When operating across the higher frequency band, any abrupt change in dimensions of the base waveguide or any discontinuities in the waveguide wall, for example, the low frequency band symmetrical iris opening, generate these undesirable higher order modes from the dominant mode input. The undesirable modes, when generated, create excessive insertion loss, trapped resonances, and degrade the feed horn performances due to higher-order mode asymmetries.

In one embodiment, the first low higher-order mode generation taper 27 is shaped and sized to transition from the first cylindrical section 22 to the second cylindrical section 24 of the outer wall 18 and to provide for low generation of high order modes of high frequency signals as described herein below.

As an example, the operating frequency band of the second port 16 is 10.70 to 14.50 GHz. The waveguide input radius at the second port 16 is approximately 0.2255 inches. There are two operating frequency bands at the first port 14, a lower operating frequency band of 5.850 to 6.425 GHz and an upper operating frequency band of 10.70 to 14.50 GHz. The radius of the first port 14 is approximately 0.650 inches. The length of the tapered region 26 between the two waveguides is selected to be approximately 1.75 inches. The shape of the first low higher-order mode generation taper 27 for the circular waveguide transition is determined as follows:

$$R(z) = 0.2255 + (0.650 - 0.2255) * \sin\left(\frac{\pi}{2} * \frac{z}{1.75}\right)^{1.75}$$

where R(z) is the radius of the first low higher-order mode generation taper 27 and z is the longitudinal position of the first low higher-order mode generation taper 27 and are both measured in the unit of inches. Also, in this embodiment, the shape of the first low higher-order mode generation taper 27 is controlled by an exponential 1.75.

In one embodiment, selection of the length of the tapered region 26 and the shape of the first low higher-order mode generation taper 27 are critical in order to maintain a low level of higher order mode generation in the tapered region 26 at the highest operating frequency band. In this embodiment, at the median frequency of the upper operating frequency band, 12.6 GHz, the dielectric loaded wavelength is approximately 0.584 inches. As mentioned above, the length of the tapered region 26 is selected to be approximately 1.75 inches which is approximately 3 wavelengths (1.75"/0.584"≈3λ) long (in terms of the composite air-dielectric waveguide effective wavelength, λ). In one embodiment, the length of the tapered region 26 is in the range of approximately 3λ–4λ, which is sufficient to prevent the generation of higher order modes levels (−30 dB or higher levels) in the first low higher-order mode generation taper 27 while providing for a well-defined effective short circuit for the lower frequency signals (5.850 GHz to 6.425 GHz). If the length of the tapered region 26 is shorter than approximately 3λ, it will provide for more abrupt shapes of the first low higher-order mode generation taper 27, which in turn generates significantly higher levels of the undesirable waveguide modes across the high frequency band (10.70 to 14.50 GHz). However, if the length of the tapered region 26 is longer than 4λ, the effective short circuit location distributes through a larger portion of the tapered region 26 which in turn results in limited availability of low reflection bandwidth of the lower frequency band.

Thus, a first low generation taper 26 is used to transform a smaller symmetrical waveguide to a larger symmetrical waveguide. The length of the first low generation taper 26 is selected to maintain the higher order modes to within an acceptable level for the high frequency band signals.

In another embodiment, the second low higher-order mode generation taper 29 is shaped and sized to conform to the longitudinal grooves 30 and to provide for low generation of high order modes of high frequency signals as described herein below.

Similar to the example above, the operating frequency band of the second port 16 is 10.70 to 14.50 GHz. The waveguide input radius at the second port 16 is approximately 0.2255 inches. There are two operating frequency bands at the first port 14, a lower operating frequency band of 5.850 to 6.425 GHz and an upper operating frequency band of 10.70 to 14.50 GHz. The radius of the first port 14 in this example is approximately 0.900 inches. As discussed above, the length of the tapered region 26 between the two waveguides is selected to be approximately 1.75 inches. The shape of the second low higher-order mode generation taper 29 for the longitudinal grooves 30 is determined as follows:

$$R_G(z) = 0.2255 + (0.900 - 0.2255) * \sin\left(\frac{\pi}{2} * \frac{z}{1.75}\right)^{1.5}$$

where $R_G(z)$ is the radius of the second low higher-order mode generation taper 29 and the z is the longitudinal position of the longitudinal groove 30 and are both measured in the unit of inches. Also, in this embodiment, the shape of the second low higher-order mode generation taper 29 is controlled by an exponential 1.5.

In one embodiment, the width of each of the grooves 30 is 0.100 inches or approximately $\lambda_0/10$ wide, where $\lambda_0$ is the free space wavelength at the median frequency of 12.6 GHz of the upper operating frequency band. The maximum depth of the longitudinal groove 30 is 0.250 inches (0.900"−0.650") which is approximately ¼ $\lambda_0$ deep. The longitudinal grooves 30 are introduced at the second port 16 and extend over the length of 1.75 inches of the tapered region 26. Although, in the embodiments discussed above, the length of the tapered region 26 is the same for both the first low higher-order mode generation taper 27 and the second low higher-order mode generation taper 29, it is known to one of ordinary skill in the art that the length of the tapered region 26 may vary between the first low higher-order mode generation taper 27 and the second low higher-order mode generation taper 29.

In one embodiment, the gradual introduction of the symmetrical set of longitudinal grooves 30 into the second low higher-order mode generation taper 29 of the tapered regions of the waveguide structure 12 is critical in order to maintain a low level of higher order mode generation in the waveguide taper region at the highest operating frequency band.

As the high frequency band signals travel through the waveguide chamber 20, the symmetrical opening of the iris openings 34 tend to disrupt the wall currents and generate significant amount of higher order modes. The longitudinal grooves 30 function to set up the wall currents such that the high frequency signal is propagated across the longitudinal grooves 30. As a result, the disruption at the wall currents is significantly reduced which in turn reduces the amount of generation of high order modes. As such the OMT device 10 of the present invention transfers the highest frequency signals through the OMJ with minimal modal distortion and low return loss.

In one embodiment, the dual frequency band includes C-band (5.850GHz-6.425 GHz) signals as the low frequency band signals and Ku-band (10.70GHz-14.5GHz) signals as the high frequency band signals. The OMT device 10 of the present invention separates dual polarized signals at the C-band and the Ku-band. The ratio value of the highest to lowest operating frequency is 2.479 (14.5 GHz/5.850 GHz=2.479) which represents the operational bandwidth. This ratio value is much larger compared to the largest frequency ratio of 1.758 (12.75 GHz/7.25 GHz=1.758) for the OMJ in the prior art. As such, the OMT device 10 of the present invention provides for a larger operational bandwidth while transferring the highest frequency signals through the OMJ with minimal modal distortion and low return loss. In another embodiment, the low frequency band signals are the Ku-band signals and the high frequency band signals are the Ka-band (18 GHz-20 GHz) signals. In a further embodiment, the low frequency band signals are the X-band signals (8 GHz-12 GHz) and the high frequency band signals are the Ka band signals.

In one embodiment, the OMT device 10 includes a dielectric rod 38 mounted coaxially within the waveguide chamber 20 extending from the first end 14 to the second end 16 of the waveguide structure 12. In one embodiment, the dielectric rod is made of rexolite, high-density cross-linked polystyrene, with a dielectric constant of approximately 2.6 and the diameter of approximately 0.450 inches. In one embodiment, the dielectric rod 38 is a low loss circular dielectric rod. The dielectric rod 38 functions to propagate the high frequency band signals (Ku-band, 10.7 GHz to 14. 5 GHz) through the circular waveguide with the symmetrical longitudinal grooves 30.

Figure 4:
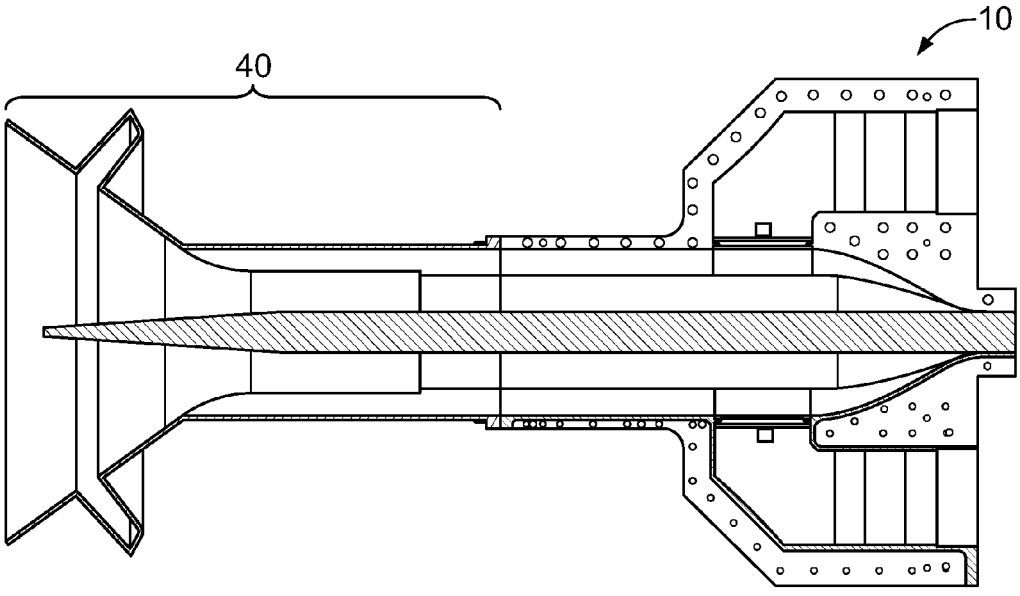
FIG. 4 depicts a schematic drawing of another embodiment of the orthomode transducer device shown in FIG. 1 in a longitudinal direction.

In another embodiment, the OMT device 10 includes a feed horn 40. Specifically, the first end 14 of the OMT device 10 which defines the first port for the signals is coupled to the feed horn 40 as shown in FIG. 4 of the present invention. The feed horn 40 functions to receive and propagate various frequency signals. Although not shown, in an alternate embodiment, the first end 14 may be coupled to a common dual polarized waveguide.

While the present invention has been described with respect to what are some embodiments of the invention, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

The invention claimed is:

1. An orthomode transducer device comprising:

a waveguide structure having a first end and a second end, wherein the first end defines a port for receiving signals, said waveguide structure having an outer wall defining a waveguide chamber therein, the outer wall including a first cylindrical section proximate the first end, a second cylindrical section proximate the second end and a region therebetween wherein at least one longitudinal groove is introduced proximate the second end and extends towards first end of the waveguide structure; and at least one waveguide coupled to the outer wall of the waveguide chamber and being in signal communication with the waveguide chamber through an opening in the region of the outer wall, wherein the at least one waveguide comprises an iris aligned within the at least one longitudinal groove of the section.

2. The device of claim 1 wherein the waveguide chamber receives low frequency band signals through the port of the first end of the waveguide structure and emits the low frequency band signals via the at least one waveguide.

3. The device of claim 2 wherein the iris is configured to couple the low frequency band signals into the at least one waveguide.

4. The device of claim 3 wherein the waveguide chamber receives and emits high frequency band signals through the port of the first end of the waveguide structure.

5. The device of claim 4 wherein the at least one waveguide further comprising at least one filter coupled to the iris, the at least one filter is configured to reduce high frequency band signals from entering into the at least one waveguide.

6. The device of claim 1 further comprising at least two equally spaced longitudinal grooves introduced approximate the second end and placed in the first end of the waveguide structure.

7. The device of claim 1 further comprising four equally spaced longitudinal grooves, wherein each of the four longitudinal grooves are introduced approximate the second end and placed in the first end of the waveguide structure.

8. The device of claim 1 further comprising four waveguides equally spaced around the section of the outer wall, wherein each of the four waveguide comprises the iris.

9. The device of claim 8 wherein each of the four waveguides comprises a filter coupled to each of the iris.

10. The device of claim 1 wherein the region is tapered such that the outer wall tapers toward the second cylindrical section.

11. The device of claim 10 wherein the region comprising a first low higher-order mode generation taper and a second low higher-order mode generation taper.

12. The device of claim 11 wherein the first low higher-order mode generation taper is shaped and sized to transition from the first cylindrical section to the second cylindrical section and provides for low generation of higher order modes of high frequency signals.

13. The device of claim 11 wherein the second low higher-order mode generation taper is shaped and sized to conform to the at least one longitudinal groove and provides for low generation of higher order modes of high frequency signals.

14. The device of claim 1 wherein the first end of the waveguide structure is coupled to at least one feedhorn.

15. An orthomode transducer device comprising:

a waveguide structure having a first end and a second end, wherein the first end defines a port for receiving signals, said waveguide structure having an outer wall defining a waveguide chamber therein, the outer wall including a first cylindrical section proximate the first end, a second cylindrical section proximate the second end and a region therebetween wherein at least one longitudinal groove is introduced proximate the second end extending towards the first end of the waveguide structure;

at least one waveguide coupled to the outer wall of the waveguide chamber and being in signal communication with the waveguide chamber through an opening in the region of the outer wall, wherein the at least one waveguide comprises an iris aligned within the at least one longitudinal groove of the section; and a dielectric rod mounted coaxially within the waveguide chamber extending from the first end to the second end of the waveguide structure.

16. The device of claim 15 wherein the waveguide chamber receives low frequency band signals through the port of the first end of the waveguide structure and emits the low frequency band signals via the at least one waveguide.

17. The device of claim 16 wherein the iris is configured to couple the low frequency band signals into the at least one waveguide.

18. The device of claim 17 wherein the waveguide chamber receives and emits high frequency band signals through the port of the first end of the waveguide structure.

19. The device of claim 18 wherein the at least one waveguide further comprising at least one filter coupled to the iris, wherein the at least one filter is configured to reduce high frequency band signals from entering into the at least one waveguide.

20. The device of claim 15 further comprising at least two equally spaced longitudinal grooves introduced approximate the second end and placed in the first end of the waveguide structure.

21. The device of claim 15 further comprising four equally spaced longitudinal grooves, wherein each of the four longitudinal grooves are introduced approximate the second end and placed in the first end of the waveguide structure.

22. The device of claim 15 further comprising four waveguides equally spaced around the section of the outer wall, wherein each of the four waveguide comprises the iris.

23. The device of claim 22 wherein each of the four waveguides comprises at least one filter coupled to the iris, wherein the at least one filter is configured to reduce high frequency band signals from entering into the at least one waveguide.

24. The device of claim 15 wherein the region is tapered such that the outer wall tapers toward the second cylindrical section.

25. The device of claim 24 wherein the region comprising a first low higher-order mode generation taper and a second low higher-order mode generation taper.

26. The device of claim 25 wherein the first low higher-order mode generation taper is shaped and sized to transition from the first cylindrical section to the second cylindrical section and provides for low generation of higher order modes of high frequency signals.

27. The device of claim 25 wherein the second low higher-order mode generation taper is shaped and sized to conform to the at least one longitudinal groove and provides for low generation of higher order modes of high frequency signals.

28. The device of claim 15 wherein the first end of the waveguide structure is coupled to at least one feedhorn.

* * * * *